United States Patent [19]

Fahlström et al.

[11] Patent Number: 4,460,376

[45] Date of Patent: Jul. 17, 1984

[54] METHOD OF RECOVERING HIGH-GRADE FUEL FROM SOLID MINERAL-FUEL RAW MATERIAL

[75] Inventors: Per A. H. H. Fahlström, Åkersberga; Erik G. Bäck, Helsingborg; Sten C. Svemar, Upplands Väsby; Bruno C. Wallstén, Sollentuna, all of Sweden

[73] Assignee: Boliden Aktiebolag, Stockholm, Sweden

[21] Appl. No.: 224,569

[22] PCT Filed: Apr. 10, 1980

[86] PCT No.: PCT/SE80/00104

§ 371 Date: Dec. 11, 1980

§ 102(e) Date: Nov. 26, 1980

[87] PCT Pub. No.: WO80/02152

PCT Pub. Date: Oct. 16, 1980

[30] Foreign Application Priority Data

Apr. 11, 1979 [SE] Sweden ..... 7903249

[51] Int. Cl.[3] ..... C10L 5/00

[52] U.S. Cl. ..... 44/1 B; 44/15 R; 44/16 C; 299/11; 208/11 R

[58] Field of Search ..... 44/16 C, 16 E, 15 R, 44/1 B; 431/2; 299/11; 405/267; 106/DIG. 1; 208/11 R

[56] References Cited

U.S. PATENT DOCUMENTS

| | | | |
|---|---|---|---|
| 3,459,003 | 8/1969 | O'Neal | 299/11 |
| 4,059,060 | 11/1977 | Gambs et al. | 44/1 SR |
| 4,081,251 | 3/1978 | Colli | 44/1 SR |
| 4,230,460 | 10/1980 | Maust, Jr. | 44/16 C |
| 4,250,134 | 2/1981 | Minnick | 106/94 |

FOREIGN PATENT DOCUMENTS 1136745 12/1968 United Kingdom .

*Primary Examiner*—Charles F. Warren
*Assistant Examiner*—Margaret B. Medley
*Attorney, Agent, or Firm*—Stevens, Davis, Miller & Mosher

[57] ABSTRACT

A method of recovering high-grade, preferably sulphur-free fuel from a bituminous or pyrobituminous mineral-fuel material, such as coal, oil shale and alum shale, wherein the raw material is finely divided into a sufficiently fine particle size for freeing the major part of bituminous or pyrobituminous raw material particles from ash-forming mineral particles, and in that the finely divided raw material is separated into a high-grade, preferably sulphur-poor, fuel concentrate which is utilized, a sulphur-containing mixture of bituminous or pyrobituminous material and ash-forming mineral and a residual product comprising mainly ash-forming mineral, and wherein a binder is produced from the sulphur-containing mixture by combusting the mixture while using its own fuel content and whereafter the binder is added to the residual product so as to hydraulically bind the product to a durable agglomerate form.

9 Claims, 3 Drawing Figures

METHOD OF RECOVERING HIGH-GRADE FUEL FROM SOLID MINERAL-FUEL RAW MATERIAL

Figure 1:
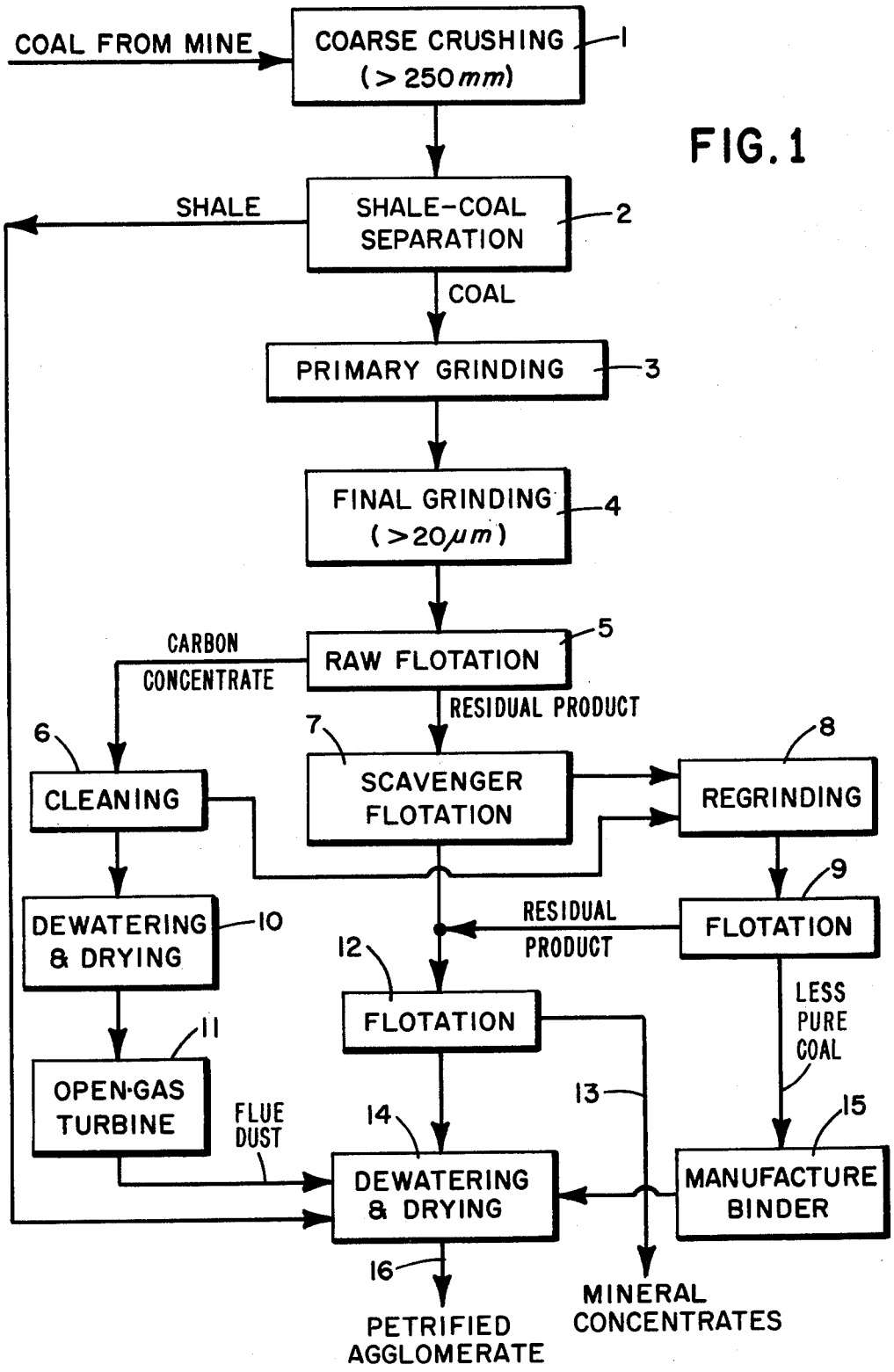

The present invention relates to a method of recovering high-grade, preferably sulphur-free, mineral-fuel concentrates from bituminous or pyrobituminous mineral-fuel raw-material, such as coal, oil shales and alum shale, said method comprising finely-dividing the raw material and separating said material into at least one mineral-fuel concentrate and a rest product which is bound to form durable particle-agglomerates.

By bituminous material is meant here generally a material which contains or consists of bitumen, i.e. organic or at least carbonaceous constituents, normally in the form of oil-soluble or tar-forming hydrocarbons. If the carbonaceous constituents in their original form can only be re-formed, either in part or completely, to bitumen when heated or in conjunction with heat (pyrolysis), the material is normally called instead pyrobituminous. Oil shales, for example, fall under this heading, in which shales the pyrobituminous material is normally called kerogen.

Although the invention is not restricted thereto, the following description is primarily concerned with such mineral-fuel raw materials which are of interest from the energy aspect and which comprise sedimentary rock, containing ash-forming substances, such as coal and oil shales. It will readily be understood that the invention can also be advantageously used for utilizing other raw materials, or in conjunction with the utilization of said other raw materials, for example for separating ash constituents from fossile fuels, such as peat and lignite, prior to thermally utilizing said fuels or combusting the same.

Bituminous and pyrobituminous rock, for example sedimentary deposits, such as coal, carbon-containing clays and oil shale, constitute a significant reserve of energy-providing raw minerals, since they exist in far greater quantities than does the mineral oil at present available. In distinction to mineral oil, a major part of the sedimentary mineral fuel-forming rocks comprise a fine-grain mass of solid mineral particles. Depending upon the prevailing conditions during and after deposition of said sediment, the bituminous mass of carbon, kerogen and lignite also contains fine-grain inorganic mineral particles, hereinafter referred to as ash-forming minerals, which often exhibit an individual particle size, substantially beneath 15 micrometers. The carbon-containing mineral particles and the inorganic mineral particles exist in mixture in different structures and bond modes. In certain cases the inorganic particles are present in layers in a mass of bitumen, while in other cases bitumen particles and inorganic particles are distributed in a more random fashion.

In addition to containing quartz and silicate-minerals of, e.g., the type clay minerals, lime spar and dolomite, the inorganic constituents also contain metallic minerals, such as pyrite and metal compounds of uranium, copper, nickel, cobalt, vanadium and molybdenum. These metals may also be present to a certain limited extent in the lattice structure of the bituminous organic mineral. Normally, sulphur is present in pyrite form, although it may also be chemically bound to the organic material.

The most common method hitherto of utilizing bituminous material of the kind described, has been either to simply combust the material and to convert the heat of combustion to other forms of energy, or to effect a heating process in the absence of air (pyrolysis) or while supplying oxygen and water (gasification) for producing volatile oils and gases, together with coke, which is either burned to convert the same to other energy forms or, e.g. is used as a chemical raw material and/or metallurgical reducing agent. In all of these cases ash is obtained as a residual product, which ash must normally be dumped at some suitable location. During the combustion process, different parts of the metal content of the original material and its sulphur content are driven off, causing particular environmental problems. Normal commercial coal contains between 10–15% ash-forming minerals, which remain either as fly-ash or some other slag product, which must be dumped. Other bituminous materials, such as carbon-containing clays and alum shales contain a much larger percentage of ash-forming mineral, and the ash-content of shales is normally as high as from 70–85%. The content of ash-forming minerals and of sulphur, which gives rise to the formation of sulphur dioxide, greatly limits a purposeful use of these energy-producing raw materials. Thus, the ash-forming mineral content and sulphur content of these energy-producing raw materials constitutes a very serious disadvantage, prejudicing the selection of processes and the use of such raw materials.

A common, serious disadvantage with present day methods, including combusting, pyrolysis and gasification of bituminous materials, resides in the fact that residual products, ashes or slags, comprising mainly ash-forming mineral particles, create serious environmental problems when finally dumped. Thus, the environmental problems created by present day techniques are quite considerable.

This is connected with the fact that plants for the further refinement of said mineral fuels and for using said fuels are often situated in the vicinity of industrial areas and urban districts. The high content of ash-forming minerals requires the provision of large areas where the ash can be dumped, while the ash-content is not chemically stable. The metal content of the material often gives rise to dust and gas emission with those combustion methods and other methods used when utilizing the material, in conjunction with thermal processes. When dumping or depositing the residual products obtained after recovering the valuable constituents from the material, the said rest products have hitherto been placed in open heaps, or in the best of cases dumped in open pits and covered with morane and earth. Sulphur-containing residual products which have not been completely combusted and which are stored in large heaps are self-ignitable, however, which may result in sulphur-dioxide and combustion gases being emitted to the surrounding air, and in the formation of sulphuric acid having the ability to leach out heavy metals from the particulate residual mass. As a result, the air, water and surrounding earth become contaminated with harmful substances.

In accordance with the present invention, these disadvantages are eliminated in a simple and effective manner. In principle, the invention is based on the concept of depositing, as far as possible, the ash material in the locations from which the bituminous or pyro-bituminous fuel material was taken. When applying present day techniques, this would mean that all plants for refining bituminous material must be placed in direct connection with these locations, which is not locally possible. For this reason, the ash material must be separated physically using mineral-technical methods incorporated in the treatment of fuel-producing raw material in connection with the primary working of said material. In simpler terms, this means that the bituminous material is enriched while simultaneously separating ash-forming constituents therefrom. With regard to coal, such enrichment requires the production of fuel products having very low ash contents, and with respect to pyrobituminous oil or alum shales, to a considerable reduction of the ash content in a kerogen concentrate. The ash content of a kerogen concentrate can be readily brought to the proximity of the ash content of that of coal, which today is considered to be of high class. Thus, in accordance with the invention mineral-fuel concentrates are prepared which have been freed from ash mineral, at the same time as the ash products are concentrated and durably stabilized.

Exhaustive development work has been undertaken to enable shale residues to be converted to building materials. When combusting shale material at 700° C., raw materials have been obtained which are suitable for producing porous ballast, bricks and ceramic clinker. When combusting said material at a temperature of 950° C., raw materials are obtained which are suitable for producing pozzolane and calcium-silicate products. The possibility of placing such products on the open market is very limited, however, in comparison with the enormous amounts of ash produced.

The object of the present invention is to provide a method by which high-grade fuel can be recovered from bituminous or pyrobituminous mineral-fuel materials, in which the aforementioned disadvantages concerning sulphur content and the deposition of residual products are eliminated.

The invention is characterized in that the raw material is finely divided to a sufficiently fine particle size, in order to release the major part of the bituminous or pyrobituminous raw material particles from ash-forming mineral particles; and in that the finely-divided raw material is physically divided into a preferably sulphur-poor fuel concentrate having an adjusted content of ash-forming material, and a residual product substantially comprising ash-forming minerals, whereat a binding agent for hydraulically bonding the residual product to a durable particle agglomerate form is produced from said adjusted content of ash-forming material when combusting the mineral-fuel concentrate or the coke content produced therefrom. Optionally, barren rock, such as certain shale material and lime, can be separated by known enrichment processes prior to finely-dividing the material, said barren material being ultimately incorporated with the remaining residual material and bound together therewith to form a durable agglomerate while using said binder. In certain cases, parts of the mineral-fuel concentrate can be permitted, to advantage, to form a separate product which is richer in ash-mineral, from which the binder for hydraulically binding the waste product is prepared, while the remaining part of the mineral fuel which is further purified from ash-forming minerals to a corresponding extent, is not used for preparing a hydraulic binder.

When said separate compound is readily available, it can be combusted together with a minor part of the residual product, wherewith a possible surplus of binder can be used for permanently binding other materials which cannot be safely dumped, while any shortage of fuel in said mixture can be compensated by adding additional fuel.

Suitably, the material is finely divided to release the bituminous particles from inorganic particles by disintegrating the raw material in one or more stages to a particle size smaller than $<25$ μm, preferably smaller than $<15$ μm, either by stepwise grinding, preferably by means of a wet two-stage or multi-stage grinding process, or by a semi-autogenous grinding process, or also by weakening and breaking the grain boundaries by gas-splitting processes or by using a chemical solvent. The combination of grinding, gas-splitting and partial leaching of such material, as described in the Swedish Patent Specification No. 7603646-6, is advantageous in this respect.

Subsequent to the last disintegration step, the organic bituminous or pyrobituminous material, such as carbon in coal, or kerogen in oil shale, can be separated from the raw material physically, after the last disintegration step in line, there being desired a bituminous-free and kerogen-free residual product comprising mainly particles of ash-forming minerals, e.g. clay minerals, lime spar and quartz. This separation is preferably effected by emulsification, flotation, density separation or magnetic separation, and the mineral percentages of the bitumen-free and kerogen-free residual products can be controlled by selection of the separation system used. Thus, in the case of minerals which can be separated magnetically, e.g. pyrite, a part concentrate can be separated by means of the HGMS (High Gradient Magnetic Separation) technique.

A pure bituminous or kerogen concentrate having a low sulphur content can be produced from the thus separated bitumen or kerogen pre-concentrate by means of various cleaning processes. The pure concentrate can be refined by known techniques, e.g. gasification, to liquid or gaseous hydrocarbon compounds of a suitable kind. The aforedescribed cleaning process is preferably carried out with flotation or selective emulsification, or optionally a combination thereof.

The fine-grain concentrate is well suited for pressure-hydration to oil. The fine-grain concentrate is also suitable for powder firing. By removing ash-forming minerals and utilizing a fine-grain product, high reaction rates and complete reactions are obtained, while the equipment used is protected against wear by the fact that the inorganic, abrasive constituents have been removed. Further, a major part of the sulphur content may have been transferred to the residual product.

When enriching bitumen or kerogen, the process lay-out may follow a number of principally separate lines. Thus, there can be taken from a concentrate the intended amount of bitumen and kerogen and the adjusted amount of ash-forming material which, when chemically treating the concentrate, leaves a desired residue intended for hydraulically binding the flotation residue. In another case, there is first taken out a highly pure concentrate, by careful flotation or emulsification, so that only very pure bitumen and kerogen particles are separated out, whereafter a so-called scavenger-separation process is effected, for separating residual middlings of bitumen and kerogen. The residue is then a bitumen-free and kerogen-free product. The scavenger concentrate can then optionally be re-ground, whereafter a cleaning separation results in an extremely pure concentrate, a less pure concentrate, and a residual product. A further line of procedure is one in which during the primary flotation or emulsifying process, bitumen or kerogen carrying products are fully separated to form a raw-concentrate, which is normally re-ground and subjected to a cleaning process, whereafter the product is divided into a highly pure bitumen or kerogen concentrate and into one or more less pure products.

In the two last mentioned methods, which are advantageous in respect of certain kinds of raw materials, in addition to a highly pure bitumen or kerogen concentrate there is also obtained a product comprising mixed granules of bitumen or kerogen, and bitumen or keorogen particles which are not readily separated. This product can not readily be refined, although it has a significant energy content, since its content of bitumen, kerogen and pyrite normally corresponds to a heat content in excess of 1,000 kWh/ton, which can be combusted to generate internal steam or energy, hereinafter also referred to as internal-fuel product. The process is normally adapted so that either the concentrate in its entirety or the internal-fuel product contains less than 20% of the ash content of the starting material.

Even though the aforedescribed, physical separation of bituminous or pyrobituminous raw material particles is preferably carried out at moderate temperatures in a wet environment, it also lies within the scope of the invention to recover, in a known manner, at least part of the bituminous raw material at elevated temperatures, to form volatile oils.

Instead of flotation and emulsification, density separation techniques may also be used, e.g. centrifuges in media of differing density. In this respect, the highly concentrate has the lowest density and the residual product the highes. By suitable selection of at least two densities, the raw material can thus be divided into concentrate and residual product and a highly pure concentrate, internal-fuel product and rest product respectively. The media normally comprise non-polar halogenated hydrocarbons or metal-salt solutions. If present in sufficient quantities, valuable constituents such as uranium, aluminium, vanadium and phosphorous can be removed from the kerogen-free product by leaching. Mineral concentrates, such as pyrite, quartz, feldspar, mica, kaolin, natrolite and lime spar can also be separated separately.

The method according to the invention enables the residual product to be dumped, to be petrified in a technically and economically acceptable manner, i.e. made hard and stabilized, so that it can safely form part of the surrounding environment, in the same safe manner as the original material. Petrification is effected by combusting or gasifying the coke content of the whole concentrate or the internal-fuel product, optionally together with a part of the residual product and optionally with a surplus of, inter alia, lime and additional fuel in, e.g., a cement furnace or a furnace for slagging, combusting or gasifying, to obtain a clinker or slag which, after being ground, provides a hydraulic binder which, in suitable proportions, optionally with an addition of Portland cement, is mixed with the remaining part of the residual product, a petrifying effect being obtained with the resultant deposition product. Tests have shown that a hydraulic binder produced in this way has very good properties.

The method according to the invention affords many important advantages. Thus, the method enables high-grade mineral fuel to be economically recovered, while the residual products are given, in a technical and environmentally favourable manner, a form which enables them to be dumped for a long period of time without risk to the environment. The residual product, and when low-grade fuels comprising a mixture of bituminous or pyrobituminous material and ash mineral are produced, also the ash or slag produced thereby, is or are per se technically unsuitable for further refinement or dumping. By means of the method according to the invention, however, there is produced a solid, petrified, stable and basic material having, from the aspect of dumping, similar or superior properties than the surrounding rock or loose soils present at the deposition or dumping site.

In a preferred embodiment, sulphur-binding material, particularly finely-ground slaked lime or dolimite, can be added to the sulphur-containing mixture of bituminous material and ash material and fuel together therewith, which may be an advantage in that residual sulphur is thus bound still more firmly to the dumped product, while forming, e.g. gypsum or oldhamite (CaS).

The waste-gas heat obtained when firing the concentrate or the said mixture or internal-fuel product (with or without intermediate gasification) can be advantageously used, for example, for producing electricity, and for driving process-apparatus, such as crushers and mills, pumps and other apparatus for carrying out the process steps of grinding and finely dividing the starting material.

In a preferred embodiment, prior to forming the agglomerates by petrification, the ash-forming particulate material can be given a water content such that, in mixture with the hydraulic binder formed during said combustion process, the water content is suitable for forming a hardened agglomerate. Since de-watering of the residual product to beneath a level of 30% by weight water, has been found particularly expensive, the remaining water can be bound to the depositable end-product by adding suitably balanced quantities of hydraulic binder.

Figure 2:
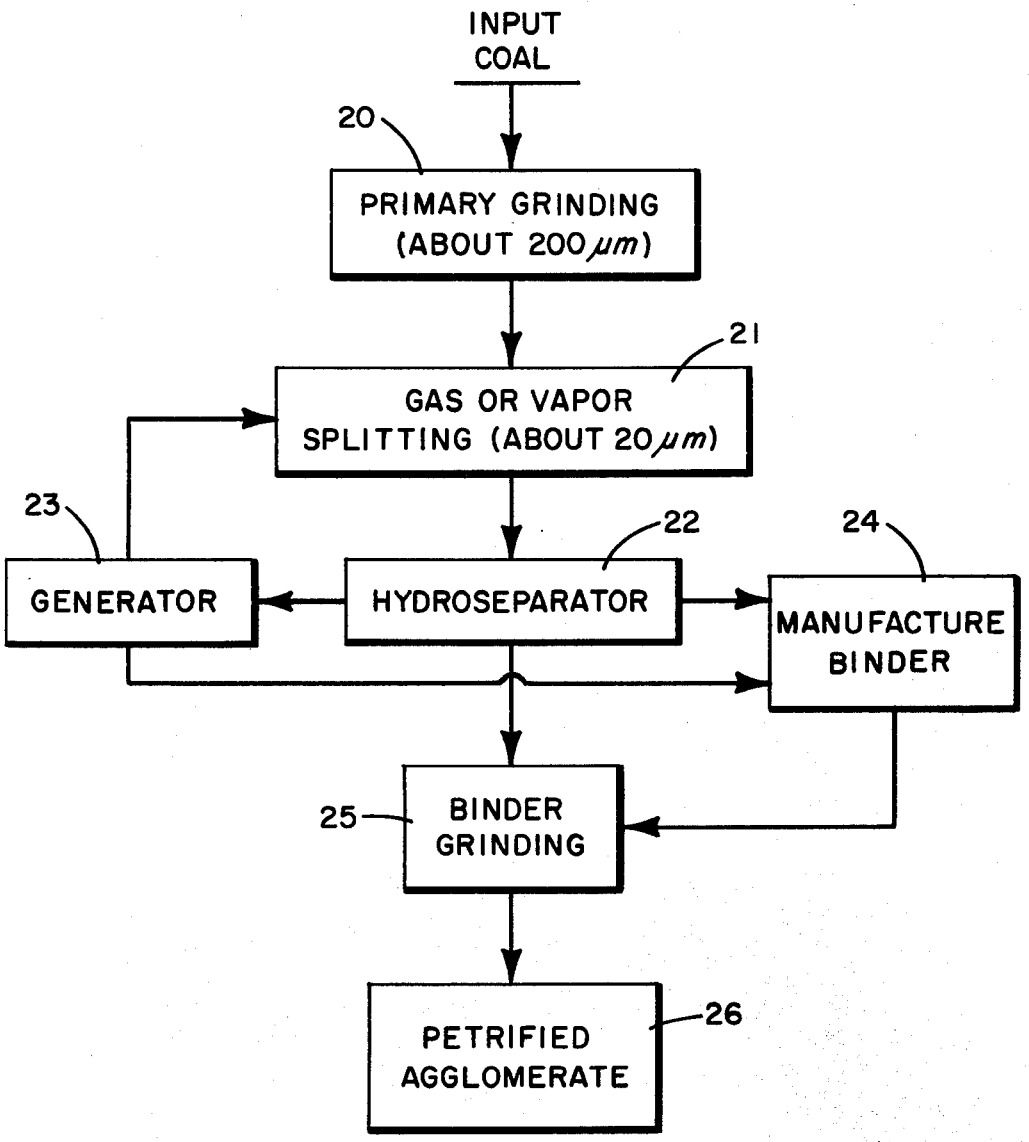
Figure 3:
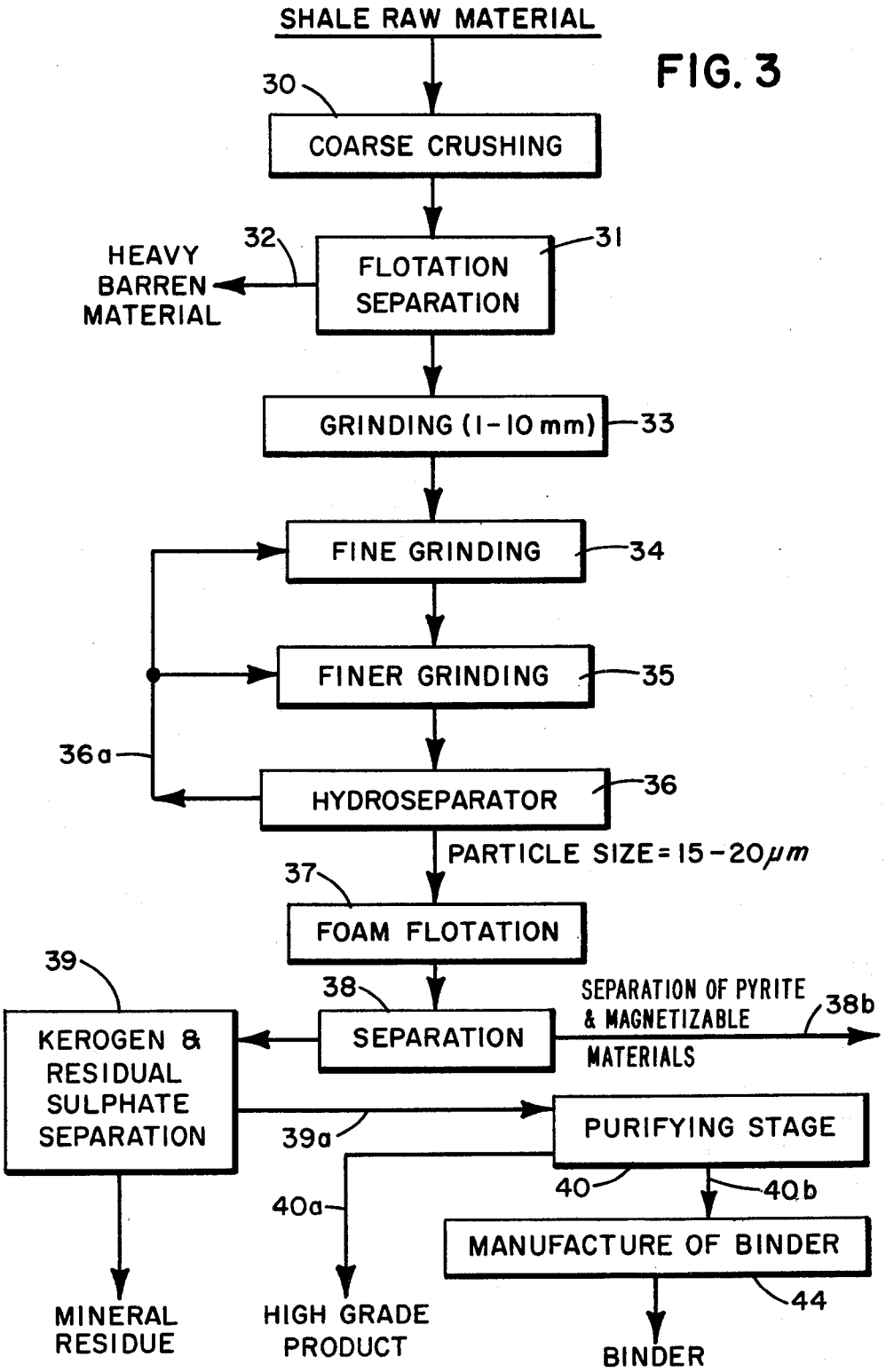

The invention will now be described in more detail with reference to the accompanying drawing, in which FIGS. 1–3 illustrate in block schematic form methods of recovering mineral-fuel concentrate, particularly high-grade fuel concentrates, from fossile fuels of differing quality.

In the plant illustrated in FIG. 1, coal is treated in the form it had when leaving the mine. The coal is transported from the mining site to a coarse-crushing stage 1, in which the coal is crushed into pieces of below about 250 mm in a shale separating stage 2. Shale material accompanying the coal is separated therefrom by sink-float methods in a manner known per se, whereon water is added and the coal subjected to a primary autogenous or semi-autogenous grinding step in a grinding stage 3, followed by a secondary and/or tertiary autogenous or semi-autogenous stage, and also ball grinding in a closed circuit having a hydrocyclone or hydro separator, arranged to separate ground material having a particle size substantially below 20 μm in stage 4. Separate pyrite flotation stages (not shown) can be incorporated upstream of or in the secondary and/or tertiary grinding stages, from which flotation stages pyrite with minor quantities of coal and heavy metals contained therein can be separately removed and utilized. The carbonaceous material ground to a finished stage in stage 4 passes directly to a raw flotation stage 5, in which careful flotation provides a carbon concentrate which is passed to a cleaning stage 6, and a residual product which, by scavenger flotation in stage 7, is divided into a concentrate containing middlings and not readily flotated coal, and a residual product which is practically free of coal. The scavenger concentrate and the residual product from the cleaning stage 6 are reground in stage 8, and subjected to a flotation process in stage 9, whereafter said concentrate and said product are divided into a less pure coal concentrate or internal-fuel product and a residual product. The coal concentrate obtained in stage 5 is cleaned in the purifying stage 6, there being obtained a highly pure coal concentrate which is de-watered and dried in stage 10 to obtain a highly-pure powdered coal which is combusted in an open gas turbine 11 for producing electrical energy.

The open gas turbine requires a powdered coal having a low ash content in order to avoid difficult erosion, corrosion and deposit problems, primarily on the turbine blades. The highly pure, very fine-grain powdered coal can also be used for a large number of other purposes. Thus, it may be used as raw material for pyrolyzing the coal to oil, gas products and coke, with subsequent gasification and burning of the coke, this method of procedure completely eliminating the residual sulphur content of the concentrate. Alternatively the coal can be used for pressure gasification or other forms of gasification of the coal material to carbon monoxide, hydrogen gas and methane, synthesis gas can be refined to, inter alia, ammonia and methanol. The fine-grain, highly pure concentrate can also be used for producing liquid hydrocarbons, by pressure-hydrating processes, so-called coal oil.

The residual products from stages 5 and 7 are passed to a flotation stage 12, where desirable mineral concentrates are recovered and led away at 13, the resultant product passing to a dewatering and preparing stage 14. The less pure coal concentrate from stage 9 is used as fuel in the manufacture of a binder in stage 15, whereafter the resultant hydraulic binder, which may optionally be further ground, is passed together with flue dust from the turbine 11 to a preparing stage 14 as an additive for petrifying the resultant residual product, including shale, from the stage 2, said product being discharged at 16 for dumping, e.g., at the mining site.

In certain cases the aforedescribed block schematic can be simplified, particularly when the mineral-fuel concentrate or concentrates are to be gasified. When the concentrate is gasified under pressure and at temperatures exceeding the melting point of the ash, there is obtained so-called slagging gasification. It is then suitable to remove, besides the pyrite concentrate, only one common mineral-fuel concentrate. In said concentrate there is required an ash content which, in the slagging gasification process, provides a balanced quantity of slag required for hydraulically binding the residual product. When carrying out the pressure-gasification step, there is obtained a molten slag which is either cooled or granulated, whereafter it is finely ground, optionally while adding slaked lime and gypsum, to amplify its hydraulic binding ability. Preferably, the concentrate is divided into mineral-fuel concentrates of different kinds and residual products, in a manner such that the division of ash mineral to mineral fuel concentrate whose ash content is slagged reached to between 10 and 15% of the non-mineral fuel-mineral content of the mined coal. FIG. 1 illustrates how the thermal treatment of the mineral-fuel concentrate is effected in close connection with the mineral-concentration plant. It will be understood that the refining line can be located at different sites. The concentrating plant can advantageously be placed on a mining site, or centrally of several mines, as can also a plant for producing the requisite hydraulic binder from the slag. If an extremely pure mineral-fuel concentrate, exhaustively freed from ash-forming minerals, is particularly produced therewith, it is convenient to place the refining stage and the use of this concentrate in plants connected with marketing areas and depositing areas for products such as electricity, steam, heat, gas etc. Suitable parts of the block schematic of FIG. 1 can also be used in the treatment of oil shales.

The block schematic illustrated in FIG. 2 represents a thermal power plant using fossile fuel. Even though such fuels do not contain more than 10–15% ash-forming minerals, serious handling and environmental problems are normally encountered when depositing fly-ash, since such plants are often located in sanitated areas. The illustrated plant of FIG. 2 minimizes, among other things, the effects of fly-ash on the environment and other demands on the surroundings, and enables advanced energy-producing processes and advanced utilization of coal for the emission-free manufacture of synthesis gas, ammonia, methanol and pyrolysis products. The input coal is subjected in stage 20 to a primary autogenous or semi-autogenous grinding process, in which the coal is ground to a particle size of about 200 μm. If the coal is fine-grained, grinding is suitably effected semi-autogenously with the addition to the mill steel-balls and/or lime-balls, e.g. balls made of flint containing limestone. The primary ground material is subjected to a gas-splitting or vapour-splitting operation in stage 21, in which the material is heated with steam or gas, which penetrate the mineral grain boundaries, which subsequent to the gas expanding are broken or weakened so that further disintegration takes place. The thus disintegrated material is further ground with an autogenous or semi-autogenous material, as in the first grinding stage, until a particle size of about 20 μm is obtained, by placing the material in a hydrocyclone or hydroseparator 22.

Subsequent to the material having been split by said steam or gas-splitting operation, the material is transferred to a liquid medium whose density can be adjusted. The material is introduced into a separation stage comprising means operating at two mutually different densities. The mutual relationship between the densities is selected so that the lightest particles, which are pure-coal particles, are collected in a light, floating phase, middlings of coal are collected in an intermediate phase, and ash-forming minerals and pyrite are collected in a heaviest phase. Separation is then effected in centrifuges. Subsequent to the separating operation, there is obtained a highly pure concentrate, an internal-fuel product and a residual product. The highly pure concentrate has an ash-forming content below 2% and a sulphur content below 0.5%, and is dewatered and charged to a MHD-generator 23 (Magneto Hydrodynamic Generator) for direct combustion in the combustion chamber thereof. In this case it is particularly important that a minimum of ash-forming mineral accompanies the material, since the hot combustion gas (over 1500° C.) which induces electric current when it passes a magnetic field in the generator must be accelerated in a wear-sensitive nozzle and must be provided with a seed, which would give rise to corrosion in the reaction with the slagged products. Normally the process purifies the material of sulphur since the seed forms sulphates with residues of combustible sulphur in the coal concentrate, which sulphate can be removed and disinintegrated. The process has a high efficiency in respect of input energy (in the order of 60%), this high efficiency being obtained, inter alia, with the aid of heat exchanges with steam turbine and condensor, which produce steam for the steam-splitting stage 21 and hot gases for drying streams of material produced in the mineral preparation stage. The internal fuel obtained in the stage 22, together with the minor quantities of fly ash from generator 23, constitute the raw materials for a binder preparing stage 24, in which further steam can be produced. The binder is dry-ground, optionally with lime and gypsum, in a preparing stage 25, and is passed together with the rest product from stage 22 and dumped in a petrified state, as indicated at 26, and covered and cultivated in a suitable manner. It is particularly convenient to use such cultivated areas for cultivating energy sources or as ground-heat sources. Plants of the kind described can, to advantage, be in the form of liquid power plants, whereby loads on urbanized districts can further be utilized. With suitable coastal conditions, the petrified residual product can be dumped in the sea, to there build foundations or small islands upon which wind-energy machines, such as windmills, can be built. Other suitable dumping sites are those areas from which the peat was taken, these areas being restored with petrified ash material, covered and cultivated.

The plant schematically illustrated in FIG. 3 is intended for mineral-fuel raw materials having a high ash-forming content, such as oil shale and alum shale. These materials have an ash-forming content of 80–90% and a sulphur content of 0.5–7%. The material is charged to a coarse crushing stage 30, in which it is subjected to a primary disintegration step for example in a feeder-crusher, whereafter water is supplied and the material subjected to wet autogenous or semi-autogenous grinding in stage 33, in which the material is ground to a maximum particle size of between 1 and 10 mm. In the case of certain materials, it may be suitable to incorporate between the coarse crushing stage and the autogenous grinding stage, a separate stage 31 which functions in accordance with the sink-float principle, for separating heavier barren material, such as limestone, at 32. The material is subjected to a further fine-grinding operation in two sequential semi-autogenous grinding stages 34, 35, with grinding bodies whose size gradually decreases. At the same time further water is added, whereafter the material is classified in hydrocyclone or hydroseparator, in which ground particles having a particle size of from 15–20 μm are separated in an overflow fraction in the hydroseparator 36. Shale material which has not been ground to the desired particle size is returned from the hydroseparator through line **36*a* to one of said mills for further grinding. Material which has been ground to the desired size is subjected to a foam flotation process in stage 37, in accordance with known techniques. The stock density is selected between 5 and 15%. Separation stages 38 can be arranged in conjunction with the flotation process, said stages comprising magnetic separations stages or stages for separating pyrite and magnetizable minerals, as indicated at 38*b*. The thus treated suspension is passed to the separation stage 39, where the kerogen content and the residual sulphate content is separated by a combination of flotation and emulsifying techniques, with, for example, non-polar organic liquids, suitably after surface activation, for example as described in Swedish Patent Specification No. 7603646-6. The flotation concentrate or crude emulsion subjected to emulsification is transferred to a purifying stage 40 over line 39*a*. The crude emulsion or flotation concentrate is divided in the purifying stage to a phase containing a less pure kerogen product, i.e. a product which also contains sulphide and sterile rock minerals, primarily in the form of middlings, with kerogen, said phase being passed to stage 44 through line 40*b*, and a phase comprising a sulphur-pure high-grade kerogen concentrate having an ash-content of 10–20% and a sulphur content of 0.5–4%. The last mentioned phase is taken out through line 40*a*** for use as a high-grade crude product for pyrolysis, gasification and like processes, and also for metallurgical reduction processes.

The concentrate is treated in a manner such that the mineral constituents are transferred to a slag having hydraulic binding properties. Subsequent to the requisite fine-grinding and optional addition of slaked lime and/or gypsum, the product is mixed with the dewatered mineral residue after kerogen flotation, whereafter the residual product is treated in the manner described in examples 1 and 2. The concentrate in question can also be used to advantage, for producing hydrocarbons and synthesis gas, and also chemical organic products, (such as chemical feedstocks). In other cases, as will be illustrated in example 1, it is sufficient to recover only a kerogen concentrate, and optionally a sulphide-mineral concentrate, thereby simplifying the process to a corresponding degree. Irrespective of the alternative chosen, it is essential that the kerogen concentrates subjected to high-temperature treatment contain sufficient ash-forming minerals to form the hydraulically-binding slag product. The thus produced kerogen concentrate is subjected to pyrolysis, gasification and a slagging final-combustion process in accordance with known techniques. An essential feature in the manufacture of the kerogen concentrate is that the separation conditions are selected so that separation of mineral residues and distribution of ash-forming minerals in kerogen concentrates of different qualities is optimal for the process procedure as a whole. As with the case of coal described by way of example in the aforegoing, a decisive factor is that a measured quantity of slag-forming mineral is added to the kerogen concentrate. This quantity, calculated on the amount of input shale is 10–15% of the shale residue after the kerogen enrichment process.

By enriching the kerogen and separating the ash, there is obtained a product which, after oil pyrolysis and gasification, has a higher coke content than the crude shale. The coke content of crude shale can normally reach to 3–5%, while that of kerogen reached to between 30 and 40%. The enriched kerogen coke permits further combustion at a temperature so high that the ash-forming minerals are slagged while forming a hydraulically binding mineral of the calcium-aluminium-silicate kind. After dry-grinding and with an optional complementary addition of slaked lime and gypsum there is obtained a slag cement in the suitably dewatered mineral residue from the kerogen enrichment process. Mixture of mineral cement, which is subjected to a hardening process, is conveyed, e.g. via pipe lines to the mining site for filling cavities created in said site and for deposition in dams, or is led particularly to areas which, subject to the mass hardening, can be cultivated. The deposition and utilization of the residual masses is, in many cases, similar to the three aforedescribed alternatives. Since there is no discervialbe difference between shale rich in kerogen and minerals and shale which is poor in these substances, it is obvious that the three illustrated examples can relate to shale as well as coal and vice versa.

This means that final combustion of coke can be effected very effectivelt with a high heat return. The final combustion stage can suitably be effected through a gasifying step for producing carbon monoxide gas which is subsequently burned and used for generating electricity in a gas turbine. The hot waste gases are used for drying purposes in the described process. The electrical energy which can be produced from kerogen coke, calculated as energy content gained per ton of shale, is between 50 and 200 kWh per ton depending upon the composition and specific properties of the shale and kerogen. This quantity of energy is sufficient to cover the internal consumption for concentrating shale kerogen, whereby the process is selfsufficient with respect to energy.

We claim:

1. In a method of recovering high-grade, preferably sulphur-free fuel from bituminous or pyrobituminous mineral-fuel material, such as coal, oil shale and alum shale, wherein the raw material is finely divided into a sufficiently fine particle size for freeing the major part of bituminous or pyrobituminous raw material particles from ash-forming mineral particles, the improvement comprising separating the finely divided raw mineral into a mineral fuel purified from ash-forming minerals, a mineral fuel containing ash-forming minerals and a residual product comprising mainly ash-forming minerals, combusting said mineral fuel containing ash-forming mineral to form a binder and thereafter adding said binder to the residual product so as to hydraulically bind said product to a durable agglomerate form.

2. The method according to claim 1, wherein said mineral fuel containing ash-forming minerals is combusted together with a minor part of the residual product.

3. The method according to claim 2, including adding and burning sulphur-binding and hydraulic binding material together with said mineral fuel containing ash-forming minerals.

4. The method according to claim 1, 2 or 3 including using waste-gas heat obtained during said combusting to operate process apparatus and carry out separate processes.

5. The method according to claim 1 including adding additional fuel to compensate for insufficient fuel in the mineral fuel containing ash-forming minerals.

6. The method according to claim 3 including adding water to said residual product prior to forming said agglomerate so that when mixed with the hydraulic binder formed during said combusting the residual product and hydraulic binder have a water content suitable for forming said agglomerate.

7. The method according to claim 6 including transporting a mixture comprising residual product and hydraulic binder formed during combusting to a dumping site and hardening the material at the site.

8. The method according to claim 7 including mining mineral-fuel material and dumping said mixture into cavities created by said mining.

9. The method according to claim 1 wherein said mineral-fuel material is finely divided in at least one stage to a particle size of less than 25 um.

* * * * *